US005858212A

United States Patent [19]

Darcy

[11] Patent Number: 5,858,212

[45] Date of Patent: Jan. 12, 1999

[54] DESULFURIZATION AND HYDROCARBON QUALITY ENHANCEMENT PROCESS

[75] Inventor: John J. Darcy, Corpus Christi, Tex.

[73] Assignee: InterGlobal Desulfuruzations Systems, Inc., Oklahoma City, Okla.

[21] Appl. No.: 675,583

[22] Filed: Jul. 3, 1996

[51] Int. Cl.[6] ..... C10G 17/00; C10G 19/00; C01B 17/16; C07C 7/00

[52] U.S. Cl. ..... 208/208 R; 208/106; 208/189; 208/219; 208/213; 208/226; 208/230; 208/237; 423/230; 585/854

[58] Field of Search ..... 208/208 R, 213, 208/226, 230, 237, 106, 189, 219; 423/230; 585/854

[56] References Cited

U.S. PATENT DOCUMENTS

| | | | |
|---|---|---|---|
| 480,312 | 8/1892 | Amend et al. | 208/226 |
| 2,035,245 | 2/1936 | Crosby et al. | 196/32 |
| 3,120,486 | 2/1964 | Braunwarth et al. | 208/213 |
| 3,699,037 | 10/1972 | Annesser et al. | 208/120 |
| 3,807,090 | 4/1974 | Moss | 208/226 |
| 3,850,745 | 11/1974 | Ellender, Jr. | 208/226 |
| 4,337,231 | 6/1982 | Yaguchi et al. | 423/243 |
| 4,347,226 | 8/1982 | Audeh et al. | 423/207 |
| 4,367,205 | 1/1983 | Kudo et al. | 423/243 |
| 4,392,947 | 7/1983 | Audeh et al. | 208/229 |
| 4,477,337 | 10/1984 | Ronden et al. | 208/226 |
| 4,481,106 | 11/1984 | Verachtert | 208/203 |
| 4,533,532 | 8/1985 | Gebhard et al. | 423/244 |
| 4,891,195 | 1/1990 | Lin | 423/243 |
| 5,199,978 | 4/1993 | Poirier et al. | 208/233 |
| 5,424,051 | 6/1995 | Nagji et al. | 423/234 |

*Primary Examiner*—Mark L. Bell
*Assistant Examiner*—Patricia L. Hailey
*Attorney, Agent, or Firm*—Shook, Hardy & Bacon LLP

[57] ABSTRACT

A hydrocarbon stream containing sulfur and sulfur compounds is contacted with a water suspension of dolomitic lime and dibasic acid catalyst in a reaction vessel in order to transfer the sulfur and sulfur compounds from the petroleum vapor to the water phase. During sulfur removal, naphthenic acid present in the hot petroleum vapor is converted to a high quality naphtha fraction. In the water phase, the sulfur compounds react with the available alkalinity from the dolomitic lime and dibasic acid. The insoluble calcium or magnesium based reaction products can then be removed from the water phase through conventional solids concentrating and separating equipment.

33 Claims, 1 Drawing Sheet

DESULFURIZATION AND HYDROCARBON QUALITY ENHANCEMENT PROCESS

BACKGROUND OF THE INVENTION

This invention relates to a desulfurization process for removing sulfur from hydrocarbon streams. More particularly as applied in a petroleum refinery, the invention relates to the desulfurization of sour crude oil while improving the quality and commercial value of the hydrocarbon products.

The modern petroleum refinery processes complex crude oils to yield a variety of useful fuels and desirable petroleum products. Such fuels and products range from gasoline, to middle distillate fuels such as kerosine and diesel oil, to fuel oil for heating, and to waxes and heavy oils such as lubricating oil and asphalt products. The crude oil itself is a complex mixture of paraffin and naphthene type hydrocarbon compounds. The desirable refinery products may be achieved by distilling or separating a product fraction from the crude, by cracking or breaking up large hydrocarbons into more valuable smaller compounds, or by creating through chemical reaction the desired products.

Sulfur compounds in petroleum can amount to several percent, as much as five percent in Venezuelan crudes, and are particularly insidious impurities which must be removed from crude oil and petroleum products. Sulfur compounds are objectable because of disagreeable odors and because they oxidize to sulfur dioxide or hydrogen sulfide which are very corrosive materials. This highly corrosive nature of sulfur compounds contribute significantly to the construction, operation and maintenance of a petroleum refinery. If present in hydrocarbon products, then sulfur compounds cause problems in gasoline engines and play a substantial role in environmental pollution.

The sulfur compounds typically problematic to the industry include hydrogen sulfide, mercaptans, sulfides, disulfides and thiophenes. A variety of processes have heretofore been known to sweeten, or desulfurize, gasolines and other petroleum stocks depending upon the particular type of sulfur compound to be removed.

Hydrotreating is a popular catalytic desulfurization process to convert sulfur compounds in a hydrogen atmosphere to hydrogen sulfide. Mercaptans may be oxidized to less undesirable disulfides or removed with known regenerative solution processes.

Many techniques are known for treating sour natural gases and petroleum vapors for hydrogen sulfide removal with a regenerative solution process. These methods deal with acid gas (hydrogen sulfide and carbon dioxide) treatment by solutions of monoethanolamine (MEA), diethanolamine (DEA), triethanolamine (TEA), methyldiethanolamine (MDEA), hot carbonate (K2CO3), and Sulfinol (40–45% tetrahydrothiophene dioxide, 40–45% diisopropanolamine and 10–20% water).

For conversion of hydrogen sulfide to elemental sulfur, the Claus process and subsequent improvements thereof have long been known. In 1833, Carl Friedrich Claus invented the process to burn hydrogen sulfide in a furnace to form sulfur and water. In later modifications of the original Claus process, some of the hydrogen sulfide is burnt in air to convert it to sulfur dioxide which is then mixed with additional hydrogen sulfide and passed over a catalyst to form sulfur.

As can be appreciated, the presence of sulfur compounds in both petroleum and natural gas processing requires added plant and treatment equipment, use of specialized plant construction materials more resistant to corrosion, and further process steps with specialty chemicals, all of which represents significant additional expense directed to the removal of sulfur. The need remains in the industry for an economical and highly effective desulfurization method adapted for natural gas and petroleum processing techniques. The primary goal of this invention is to meet this need, and to overcome the many drawbacks previously experienced in desulfurization processes.

SUMMARY OF THE INVENTION

More specifically, an object of the invention is to provide a desulfurization process to remove sulfur and sulfur compounds from light end petroleum vapors.

Another object of the invention is to provide a desulfurization process adapted to remove acid gas from sour natural gas. Thus, the natural gas may be sweetened at the well site whereby the undesirable, but nonhazardous impurities can be returned underground.

Another object of the invention is to provide a process to improve the quality and commercial value of refinery hydrocarbon streams by increasing octane rating. This objective is accomplished through dehydrogenation of alicyclic compounds to aromatic compounds such as the conversion of naphthene to toluene, benzene or the like.

Another object of the invention is to provide a process to improve the quality and commercial value of refinery hydrocarbon streams by hydrocracking paraffins so that long chain molecules may be broken into more volatile, shorter chain molecules.

Yet another object of the invention is to provide a process to improve the quality and commercial value of refinery hydrocarbon streams as previously described whereby straight chain paraffins are cyclized through isomerization to increase octane rating.

A further object of the invention is to provide a process to improve the quality and commercial value of refinery hydrocarbon streams whereby straight chain paraffins are dehydrocyclized to naphthenes which, in turn and as previously described, may be converted to an aromatic product.

An additional object of the invention is to provide a process to improve the quality and commercial value of refinery hydrocarbon streams by producing high quality naphtha from light end hydrocarbon (PFD) streams of the petroleum refinery.

Another object of the invention is to provide a desulfurization process of the character previously described which is adapted to remove sulfur and sulfur compounds from middle distillates (MDO) in the petroleum refinery.

Another object of the invention is to provide a desulfurization process of the character previously described which is adapted to reduce corrosion in the refinery by removing naphthenic acid as a naphtha product.

Yet another object of the invention is to provide a desulfurization process of the character previously described which reduces ammonia and amine consumption of a refinery by reducing acidity of the petroleum stream.

A further object of the invention is to provide a desulfurization process of the character previously described which significantly reduces the cost of removing sulfur compounds from petroleum streams by replacing prior art sulfur removal processes.

In summary, a hot petroleum vapor stream containing sulfur and sulfur compounds is contacted with a water suspension of dolomitic lime and dibasic acid in a reaction vessel in order to transfer the sulfur and sulfur compounds from the petroleum vapor to the water phase. During sulfur removal, naphthenic acid present in the hot petroleum vapor is converted to a high quality naphtha fraction. In the water phase, the sulfur compounds react with the available alkalinity from the dolomitic lime and dibasic acid. The insoluble calcium-based reaction products can then be removed from the water phase through conventional solids concentrating and separating equipment. The absorbing liquor is then recycled back to the feed tank for makeup control and subsequent return to the reaction vessel. The removed calcium-based sulfur and sulfur-related compounds that have been concentrated into solids can be disposed in an environmentally acceptable manner.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
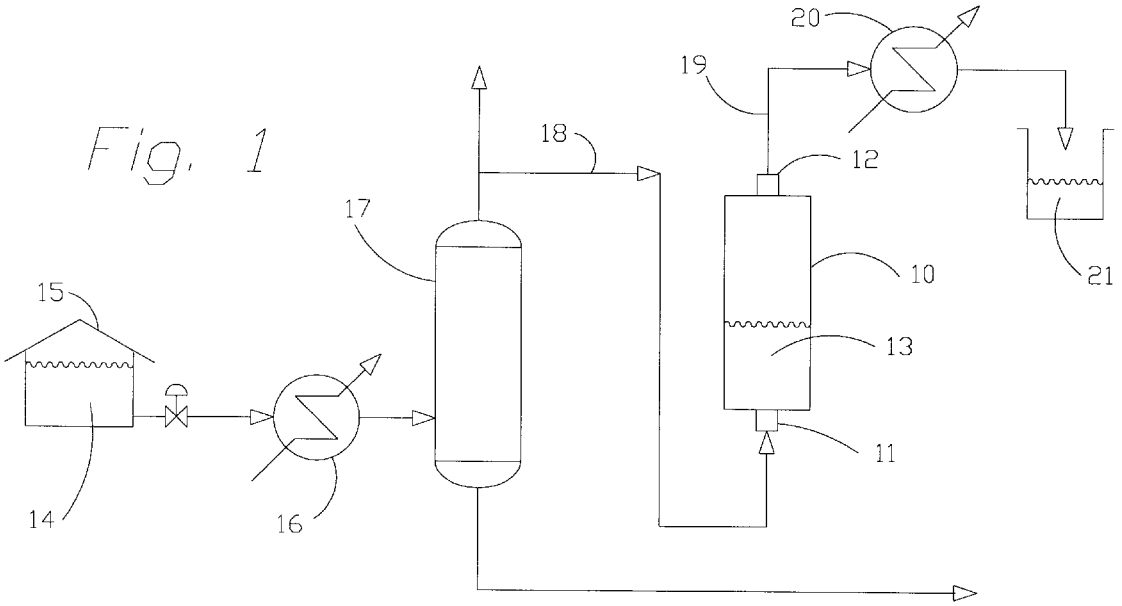
FIG. 1 is a schematic process flow diagram illustrating test equipment used to practice a batch mode embodiment of the desulfurization and hydrocarbon enhancing process.

In the preferred embodiment of the invention as applied to refinery operations, a lime/catalyst water slurry is reacted with a vapor phase petroleum stream to remove sulfur compounds such as hydrogen sulfide, mercaptans and the like. The reactive solution contains a lime component such as lime, dolomitic lime, limestone, or dolomitic limestone, a dibasic acid catalyst and water. The solution is introduced in a mass transfer relationship with the petroleum stream to be treated. This may be accomplished by passing petroleum vapors through a pool of the lime/catalyst solution or spraying the solution countercurrent or co-current to the vapor stream utilizing steady state processing techniques.

The vapor temperature for the reaction may be carried out between a broad operating range of 200° F. and 930° F. as the reaction is usually carried out at atmospheric conditions. A preferred operating temperature range is from 200° F. to 650° F. since temperatures above 650° F. at atmospheric pressure causes a form of cracking that may be undesirable. The most desirable temperature range appears to be from 400° F. to 450° F. for atmospheric conditions. However, the reaction can also be carried out under vacuum.

As previously mentioned, the lime component of the reactive solution is preferably lime (CaO), dolomitic lime (MgO.CaO), limestone ($CaCO_3$), or dolomitic limestone ($CaCO_3.MgCO_3$). Accordingly, the magnesium compounds likely present and useful in the invention include magnesium oxide (MgO), magnesium hydroxide ($Mg(OH)_2$), magnesium carbonate ($MgCO_3$), and magnesium bicarbonate ($Mg(HCO_3)_2$). Likewise, the calcium compounds likely present and useful in the invention include calcium oxide (CaO), calcium hydroxide ($Ca(OH)_2$), calcium carbonate ($CaCO_3$), and calcium bicarbonate ($Ca(HCO_3)_2$). Sodium and potassium compounds may also be used in the process. These include sodium oxide ($Na_2O$), sodium hydroxide (NaOH), sodium carbonate ($Na_2CO_3$), sodium bicarbonate ($NaHCO_3$), soda ash, nagalite, potassium oxide ($K_2O$), potassium hydroxide (KOH), potassium carbonate ($K_2CO_3$), and potassium bicarbonate ($KHCO_3$).

The amount of lime component present in the reactive solution may be broadly in the range of 2 to 15% by weight, with a preferred range of 8 to 12% by weight, and an optimum presence of about 10% by weight. Dolomitic limestone has been used with good results when present in the amount of 10% by weight.

The dibasic acid catalyst used in the reactive solution is one or more dicarboxylic acids from $C_4$ through $C_{12}$. In other words, these acids include succinic acid (butanedioic acid) having the structure HOOC—$(CH_2)_2$—COOH, glutaric acid (pentanedioic acid) having the structure HOOC—$(CH_2)_3$—COOH, adipic acid (hexanedioic acid) having the structure HOOC—$(CH_2)_4$—COOH, pimelic acid (heptanedioic acid) having the structure HOOC—$(CH_2)_5$—COOH, suberic acid (octanedioic acid) having the structure HOOC—$(CH_2)_6$—COOH, azelaic acid (nonanedioic acid) having the structure HOOC—$(CH_2)_7$—COOH, sebacic acid (decanedioic acid) having the structure HOOC—$(CH_2)_8$—COOH, undecanedioic acid having the structure HOOC—$(CH_2)_9$—COOH, and dodecanedioic acid having the structure HOOC—$(CH_2)_{10}$—COOH. Good results have been obtained particularly with the $C_4$ through $C_6$ dicarboxylic acids.

The amount of dibasic acid catalyst present in the reactive solution may be broadly in the range of 1 to 10% by weight, with a preferred range of 3 to 7% by weight, and an optimum presence of about 5% by weight. Adipic acid was used in early test work with good results when present in the amount of 5% by weight.

Water makes up the final component of the lime/catalyst solution.

The reactive solution may be used at ambient temperatures to react with the hydrocarbon vapor having a temperature within the ranges previously set forth. However, in order to minimize heat loss in a spray tower operation, heating the reactive solution to fall within the temperature range of ambient to 180° F. may be advantageous.

The pH of the reactive solution is not thought to be critical to the effectiveness of the treatment. The pH may be held within a working range or 4.2 to 8.3 so that scaling does not occur inside the reaction vessel. A more preferable pH range is from 5.0 to 6.5, and an ideal pH range is from 5.2 to 6.0.

In the petroleum streams treated, the sulfur compounds present are largely mercaptans. Streams containing as high as 1% by weight sulfur have been successfully treated but it is believed that higher concentration could also be advantageously processed using the same technique.

Although the reaction mechanisms that occur are not thoroughly known, the petroleum product of the reaction is virtually sulfur free and contains higher quality hydrocarbon compounds than those existing in the feed stock. The reaction appears to be almost instantaneous. During tests, the contact time of the petroleum vapors and the lime/catalyst solution was less than two seconds. It is thought that the water slurry containing lime, dolomitic lime, limestone, or dolomitic limestone is reacted with the vapor phase of the petroleum stream, in the presence of the dibasic acid catalyst, to cleave the "—SH" radical from organo sulfurous compounds present in petroleum. The molecular structure of the components are altered in the reaction. The "—SH" radicals thus formed and the hydrogen sulfide present combine with the lime to produce calcium sulfite ($CaSO_3$) that can be removed in the aqueous phase to a water treatment plant. Solids disposal can be accomplished safely to a landfill since the products are nonhazardous. Accordingly, the reaction mechanism appears to involve the breakup of mercaptan groups present in petroleum as represented by the following.

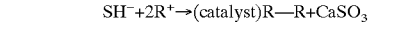

$$R—SH+Ca(OH)_2 \rightarrow (catalyst)R^+ + SH^-$$

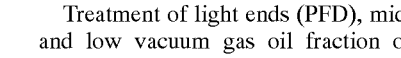

$$SH^- + 2R^+ \rightarrow (catalyst)R—R + CaSO_3$$

Treatment of light ends (PFD), middle distillates (MDO) and low vacuum gas oil fraction of crude oil with the lime/catalyst solution as heretofore described results in significant improvement in the quality and commercial value of the hydrocarbon stream. This results in more highly branched heterocyclic compounds than existed in the feed stock. Another reaction that occurs is cracking of longer chain moieties into highly branched heterocyclic and aromatic compounds not existent in the feed stock. The foregoing results have been confirmed by chromatographic and mass spectrographic techniques.

The conventional reforming process (sometimes referred to as platformating) employs a platinum catalyst to convert low octane naphtha into high octane full range platformate product. Isomerization, hydrocracking, aromatization, and dehydrocyclization are reactions which take place in the process. The platformate is split to produce an aromatic rich feed stock for benzene, toluene, xylene (BTX) unit and a high octane blending component for gasoline. As is known in the art, prior to feeding a sulfur containing stream to the platformer, it must be processed in a hydrotreater (Unibon) which, in the presence of excess hydrogen, removes sulfur, oxygen, nitrogen, and organometallic compounds and also saturates olefins to more desirable paraffins.

The lime/catalyst treatment process as herein disclosed is believed to be a suitable alternative to traditional platformating techniques since the hydrocarbon reactions now to be discussed have resulted from such treatment.

Naphthenes (i.e., cycloalkanes) present in the petroleum stream may be dehydrogenated to aromatic compounds. For example, methyl cyclohexane ($CH_3C_6H_{11}$) may be dehydrogenated to toluene ($C_6H_5CH_3$) and hydrogen ($H_2$). The most common naphthenes are cyclohexane ($C_6H_{12}$) and methyl cyclopentane ($CH_3C_5H_9$). When treated with the lime/catalyst solution of this invention, great improvement in octane rating is achieved by conversion of cycloalkanes to more valuable aromatics.

Hydrocracking also results from the inventive process whereby long chain paraffins are broken into shorter chain molecules. For example, dodecane ($C_{12}H_{26}$) may be combined with a hydrogen molecule to yield two molecules of hexane ($C_6H_{14}$). The hexanes are then further cyclized to cyclohexane by isomerization. In other words, hexane is converted to 3-methyl pentane which is then converted to methyl cyclopentane which is lastly converted to cyclohexane.

Reduction of the hydrocarbon chain length of oil molecules, as by cracking, also permits the subsequent production of more valuable materials. For example, ethylene may be produced from naphtha.

Results of the inventive process also suggests the dehydrocyclization of paraffins to naphthenes. For example, heptane ($C_7H_{16}$) may be converted to methyl cyclohexane and hydrogen.

Accordingly, the process results show an increase in branching in the alicyclic cyclohexanes and aromatics which increases their value as gasoline additives or as basic chemicals. Since this process also removes virtually all of the sulfur compounds present, it is extremely valuable as a chemical intermediate for further processing. At the same time, the sulfurous compounds do not attack the alloy vessels used in the refinery.

In addition to treating the refinery light ends (PFD) and middle distillates (MDO), the lime/catalyst process as disclosed may be advantageously used to treat lube oil fractions. These are materials which have a boiling range of 662° F. to 932° F. They are present in the wax oil and asphaltic portions of the crude oil. This petroleum fraction is a very complex mixture composed of approximately 18 to 26% long straight chain paraffins and some branched paraffins, 43 to 51% alkylated naphthenes containing 1, 2, or 3 rings, approximately 23% alkylated naphthene—aromatic hydrocarbons, and approximately 8% asphaltic substances considered to be largely aromatics.

Apart from its significant value in desulfurization, the lime/catalyst treatment process of this invention provides a new method of producing high quality naphtha. Naphthenic acids are found in the asphaltic portion of the crude petroleum. The constituents are primarily cycloparaffinic acids derived from naphthalene components and are highly corrosive to metal. When treated with a lime/catalyst solution produced in accordance with the teachings of this invention, naphthenic acids, the most common of which include benzoic acid, cyclopentane carboxylic acid, and methyl cyclohexane carboxylic acid, are converted to aromatic branched compounds. Very stable water white compounds having greatly increased commercial value are thus produced.

Lastly, the lime/catalyst process of this invention can be utilized to treat natural gas. Natural gas occurs as gas bubbles in oil fields. It can also be dissolved in crude oil. The composition of natural gas varies pending upon its origin. It always contains methane ($CH_4$) and may also contain ethane ($C_2H_6$), propane ($C_3H_8$), and butane ($C_4H_{10}$). In addition, natural gas characteristically contains, in varying proportions, the gases hydrogen ($H_2$), nitrogen ($N_2$), carbon dioxide ($CO_2$), hydrogen sulfide ($H_2S$), and helium (He).

The hydrogen sulfide and carbon dioxide content makes the gas sour. These materials need to be removed from the raw natural gas to sweeten the natural gas. Various processes such as Sulfinol and Claus which are monstrous sized plants are presently used for this purpose. The sour natural gas causes problems in the pipelines and must be removed before it can be used for heating or as a raw material for chemical production.

Natural gas can be sweetened by treating the warm natural gas vapors with the lime/catalyst solution of this invention, in relatively small equipment as compared with other methods of sulfur removal. The clean natural gas may then be compressed and transported by pipeline. The sulfur and carbon dioxide are combined with water from the well and returned underground as a non-hazardous material.

With reference to FIG. 1, a batch type process representative of this invention was used to treat a flash drum overhead stream in a petroleum refinery in accordance with the following example.

EXAMPLE 1

A four foot section of schedule 80 steel pipe, eight inches in diameter, served as the reaction vessel 10. Lids were bolted to both ends of the steel pipe thus making a closed reaction chamber. A vapor nozzle inlet 11 to the bottom of the reaction chamber was a one-half inch diameter stainless steel pipe and the outlet 12 at the upper end of the reaction chamber was a one-half inch stainless steel pipe.

A lime/catalyst solution 13 was charged to the reaction chamber 10. The solution contained 1.5 gallons of dolomitic agricultural lime solution and 0.5 gallon of 2% by weight adipic acid.

Crude 14 pumped from a storage tank 15 in the refinery's tank farm was delivered to a feed preheater 16 and then to the flash drum 17 in accordance conventional plant operation. A vapor feed side stream 18 of light ends from the crude oil flash drum 17 was fed to the bottom inlet 11 of the reaction chamber 10 and allowed to bubble through the lime/catalyst solution 13. The vapor flow through the reaction chamber was about 30 feet per second. The temperature of the vapor feed was approximately 450° F. The vapor feed had the following additional characteristics:

| | |
|---|---|
| Sulfur | 0.9% |
| API @ 60° F. | 34.2 |
| Density | 7.11 |
| Sp. Gr. | 0.854 |
| Color | Dark (almost black) unstable |

The overhead vapor stream 19 of treated gases from the reaction chamber were piped to a condenser 20 for collection and analysis of the recovered liquid hydrocarbons 21. The boiling points of the hydrocarbon products 21 from this new process were up to 382° F., with the majority falling in the range of 168° to 382° F. The recovered liquid hydrocarbons had the following additional characteristics:

| | |
|---|---|
| Sulfur | 0.0001% |
| API @ 60° F. | 70 |
| Density | 5.85 |
| Sp. Gr. | 0.7022 |
| Color | Water white stable |

Test results indicated that 99.9% of the total sulfur was removed. After six months storage, samples remained unchanged in physical or chemical characteristics and continued to display a water white color. Chromatographic studies indicated that much branching occurred and longer chain materials were cracked into smaller units converted to branched heterocyclic and aromatic compounds.

Figure 2:
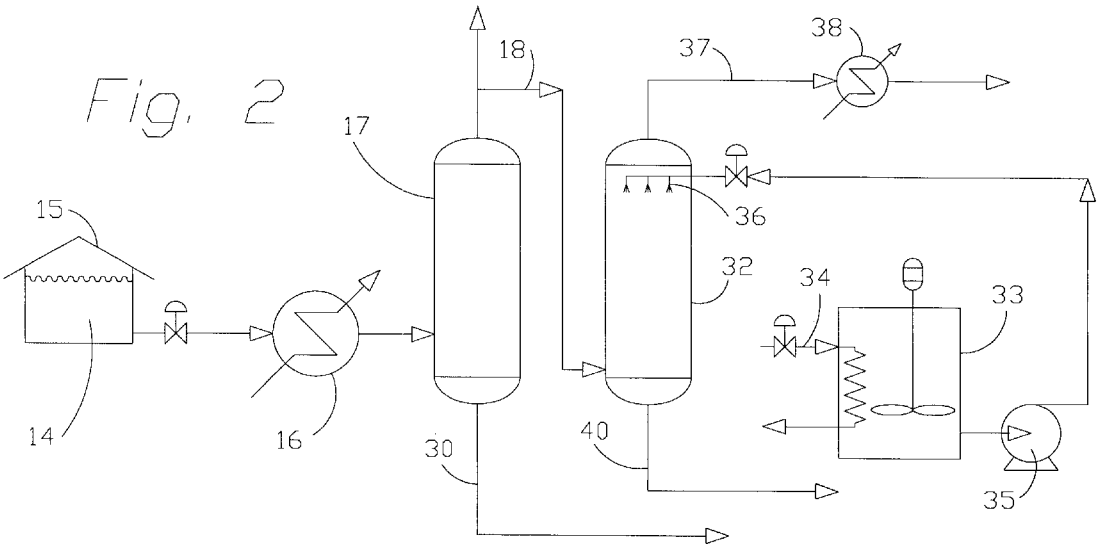
FIG. 2 is a schematic process flow diagram illustrating a continuous mode embodiment of the desulfurization and hydrocarbon enhancing process according to the invention.

With reference to FIG. 2, a continuous process representative of this invention was used to treat a flash drum overhead stream in a petroleum refinery in accordance with the following example.

EXAMPLE 2

Crude 14 pumped from a storage tank 15 in the refinery's tank farm was delivered to a feed preheater 16 and then to the flash drum 17 in accordance conventional plant operation. The heavy liquid bottoms stream 30 is sent to the plant's distillation tower for further processing. A sidestream 18 of the light ends gas overhead from the flash drum 17 is delivered to the bottom of a reactor 32.

From a 300 gallon capacity, stirred storage tank 33, fitted with a heater 34 connected to the refinery's steam heating system, a lime/catalyst solution is delivered by pump 35 to spray heads 36 positioned in the top of the reactor 32. Thus, the gas stream 18 delivered to the bottom of the reactor 32 experiences a counterflow, mass transfer relationship with the lime/catalyst solution from the spray heads 36.

The overhead vapor stream 37 of treated gases from the reactor 32 were piped to a condenser 38 for collection and analysis of the recovered liquid hydrocarbons. The bottoms liquid stream 40 from the reactor contains, as calcium sulfite ($CaSO_3$), the sulfur recovered from the petroleum feed. The bottoms stream 40 is sent to further processing for recovery and disposal of the sulfur removed from the feed. This may include the oxidation of calcium sulfite to calcium sulphate ($CaSO_4$) using conventional processing systems to yield a saleable gypsum product.

Two different formulations of a reactive solution made in accordance with the principles of this invention were tested with the foregoing process flow scheme.

In a calcium oxide/catalyst solution, the reactive spray to the reactor comprised approximately 10% by weight calcium oxide (CaO), 5% by weight DBA dicarboxylic acid (a commercially available mixture of $C_4$ through $C_6$ dicarboxylic acids) and 85% by weight makeup water. In a dolomitic oxide/catalyst solution, the reactive spray to the reactor comprised about 10% by weight dolomitic oxide (MgO.CaO), 5% by weight DBA dicarboxylic acid and 85% by weight makeup water.

The feed stream to the reactor, the overhead stream treated with the calcium oxide/catalyst solution, and the overhead stream treated with the dolomitic oxide/catalyst solution were all subjected to quantitative analysis to determine sulfur content. Sulfur was present in the vapor feed primarily in the form of mercaptans. Analysis of the feed determined the following characteristics:

| | |
|---|---|
| Sulfur | 0.532% |
| API @ 60° F. | 49 |
| Density | 6.523 |
| Sp. Gr. | 0.854 |
| Color | Dark—unstable |

The recovered overhead liquid hydrocarbons treated with the calcium oxide/catalyst solution were determined to have the following properties:

| | |
|---|---|
| Sulfur | 0.0011% |
| API @ 60° F. | 69 |
| Density | 5.912 |
| Sp. Gr. | 0.7118 |
| Color | Water white stable |

In the second test run, the recovered overhead liquid hydrocarbons treated with the dolomitic oxide/catalyst solution were determined to have the following properties:

| | |
|---|---|
| Sulfur | 0.0009% |
| API @ 60° F. | 62 |
| Density | 6.081 |
| Sp. Gr. | 0.7359 |
| Color | Water white stable |

The bottoms stream from the reactor contained no hydrocarbons. The feed stream to the reactor, the overhead stream treated with the calcium oxide/catalyst solution, and the overhead stream treated with the dolomitic oxide/catalyst solution were all subjected to rigorous laboratory analysis for hydrocarbons using ASTM standard D-5134.

The following tables show the hydrocarbon analysis of the untreated feed, the calcium oxide/catalyst treated overhead, and the dolomitic oxide/catalyst treated overhead. The last table compares the results of both treatments.

| Untreated Feed | | | |
|---|---|---|---|
| Component Name | Wt. % | LV. % | Mole % |
| Propane | 0.23 | 0.36 | 0.64 |
| Isobutane | 0.40 | 0.56 | 0.83 |
| N-Butane | 1.26 | 1.69 | 2.63 |
| 2,2-Dimethylpropane | 0.02 | 0.03 | 0.05 |
| Isopentane | 2.03 | 2.48 | 3.42 |
| N-Pentane | 1.85 | 2.29 | 3.10 |
| 2,2-Dimethylbutane | 0.15 | 0.17 | 0.21 |
| Cyclopentane | 0.40 | 0.41 | 0.69 |
| 2,3-Dimethylbutane | 0.58 | 0.68 | 0.82 |
| 2-Methylpentane | 1.49 | 1.77 | 2.09 |
| 3-Methylpentane | 1.43 | 1.67 | 2.01 |
| N-Hexane | 1.83 | 2.15 | 2.57 |
| 2,2-Dimethylpentane | 0.10 | 0.11 | 0.14 |
| Methylcyclopentane | 1.75 | 1.82 | 2.52 |
| 2,4-Dimethylpentane | 0.24 | 0.28 | 0.30 |
| 2,3,3-Trimethylbutane | 0.05 | 0.06 | 0.06 |
| Benzene | 0.24 | 0.21 | 0.37 |
| 3,3-Dimethylpentane | 0.08 | 0.09 | 0.09 |
| Cyclohexane | 1.47 | 1.55 | 1.93 |
| 2-Methylhexane | 0.65 | 0.75 | 0.79 |
| 2,3-Dimethylpentane | 0.74 | 0.83 | 0.90 |
| 1,1-Dimethylcyclopentane | 0.28 | 0.29 | 0.34 |
| 3-Methylhexane | 1.25 | 1.42 | 1.52 |
| Cis-1,3-dimethylcyclopentane | 0.61 | 0.64 | 0.76 |
| Trans-1,3-dimethylcyclopentane | 0.58 | 0.60 | 0.71 |
| 3-Ethylpentane | 0.23 | 0.27 | 0.28 |
| Trans-1,2-dimethylcyclopentane | 0.93 | 0.96 | 1.15 |
| 2,2,4-Trimethylpentane | 0.00 | 0.00 | 0.00 |
| N-Heptane | 1.21 | 1.37 | 1.46 |
| Methylcyclohexane | 2.96 | 2.99 | 3.66 |
| 1,1,3-Trimethylcyclopentane | 0.33 | 0.34 | 0.36 |
| Ethylcyclopentane | 0.43 | 0.44 | 0.53 |
| 2,5-Dimethylhexane | 0.18 | 0.21 | 0.20 |
| 2,4-Dimethylhexane | 0.33 | 0.37 | 0.35 |
| Trans, cis-1,2,4-triethylcyclopentane | 0.48 | 0.51 | 0.51 |
| 3,3-Dimethylhexane | 0.08 | 0.08 | 0.08 |
| Trans, cis-1,2,3-triethylcyclopentane | 0.61 | 0.63 | 0.66 |
| 2,3,4-Trimethylpentane | 0.15 | 0.16 | 0.16 |
| Toluene | 0.59 | 0.53 | 0.77 |
| 2-Methyl-3-Ethylpentane | 0.14 | 0.15 | 0.15 |
| 2-Methylheptane | 0.58 | 0.65 | 0.62 |
| 4-Methylheptane | 0.42 | 0.46 | 0.44 |
| 3,4-Dimethylhexane | 0.09 | 0.10 | 0.09 |
| Cis,trans, 1,2,4-trimethylcyclopentane | 0.07 | 0.07 | 0.08 |
| 3-MethylC7 + Cis, trans, 1,2, 3-Trimethy | 1.25 | 1.38 | 1.33 |
| Trans-1,4-dimethylcyclohexane | 0.84 | 0.85 | 0.90 |
| 1,1-Dimethylcyclohexane | 0.54 | 0.54 | 0.59 |
| 3-Ethylhexane | 0.31 | 0.33 | 0.32 |
| Trans-1-ethyl-3-methylcyclopentane | 0.23 | 0.23 | 0.25 |
| Cis-1-ethyl-3-methylcyclopentane | 0.21 | 0.21 | 0.23 |
| Trans-1-ethyl-2-methylcyclopentane | 0.54 | 0.55 | 0.58 |
| 1-Ethyl-1-methylcyclopentane | 0.06 | 0.06 | 0.06 |
| Trans-1,2, dimethylcyclohexane | 0.82 | 0.82 | 0.89 |
| 2,2,4-Trimethylhexane | 0.05 | 0.05 | 0.04 |
| 1,1,2-trimethylcyclopentane | 0.46 | 0.46 | 0.50 |
| Trans-1,3-dimethylcyclohexane | 0.01 | 0.01 | 0.01 |
| N-Octane | 1.18 | 1.31 | 1.25 |
| Isopropylcyclopentane | 0.17 | 0.17 | 0.18 |
| Cis-1-ethyl-2-methylcyclopentane | 0.07 | 0.07 | 0.08 |
| Cis-1,2-dimethylcyclohexane | 0.42 | 0.41 | 0.45 |
| 4,4-Dimethylheptane | 0.02 | 0.02 | 0.02 |
| n-Propylcyclopentane | 0.05 | 0.05 | 0.06 |
| 2,6-Dimethylheptane | 0.34 | 0.37 | 0.32 |
| 1,1,3-Trimethylcyclohexane | 1.85 | 1.85 | 1.78 |
| Ethylcyclohexane | 1.24 | 1.24 | 1.19 |
| 2,5-Dimethylheptane | 0.49 | 0.53 | 0.46 |
| 3,5-Dimethylheptane | 0.10 | 0.11 | 0.10 |
| Ethylbenzene | 0.82 | 0.74 | 0.94 |
| Cis, trans, 1,3,5-trimethylcyclohexane | 0.42 | 0.42 | 0.40 |
| Meta-Xylene | 0.45 | 0.41 | 0.52 |
| Para-Xylene | 0.67 | 0.60 | 0.76 |
| 2,3-Dimethylheptane | 0.07 | 0.07 | 0.06 |
| C9 Naphthene | 2.29 | 2.29 | 2.20 |
| 4-Ethylheptane | 0.18 | 0.19 | 0.17 |
| 4-Methyloctane | 0.22 | 0.24 | 0.21 |
| 2-Methyloctane | 0.17 | 0.19 | 0.16 |

-continued

| Untreated Feed | | | |
|---|---|---|---|
| 3-Ethylheptane | 0.00 | 0.00 | 0.00 |
| 3-Methyloctane | 0.65 | 0.71 | 0.61 |
| Ortho-Xylene | 0.63 | 0.56 | 0.72 |
| C10 Paraffin | 0.55 | 0.60 | 0.52 |
| 1-Methyl-2-propylcyclopentane | 0.56 | 0.54 | 0.54 |
| Cis-1-ethyl-3-methylcyclohexane | 0.48 | 0.47 | 0.46 |
| Trans-1-ethyl-4-methylcyclohexane | 0.37 | 0.36 | 0.35 |
| N-Nonane | 0.72 | 0.78 | 0.68 |
| Trans-1-ethyl-3-methylcyclohexane | 0.50 | 0.50 | 0.48 |
| 1-Ethyl-1-methylcyclohexane | 0.14 | 0.14 | 0.13 |
| Isopropylbenzene | 0.15 | 0.13 | 0.15 |
| Isopropylcyclohexane | 0.35 | 0.35 | 0.34 |
| N-propylcyclohexane | 0.15 | 0.15 | 0.15 |
| N-butylcyclopentane | 0.65 | 0.64 | 0.62 |
| 3,6-Dimethyloctane | 0.46 | 0.50 | 0.40 |
| 3,3-Dimethyloctane | 0.48 | 0.51 | 0.41 |
| n-Propylbenzene | 0.38 | 0.34 | 0.38 |
| 1-Methyl-3-ethylbenzene (METOL) | 0.25 | 0.22 | 0.25 |
| 1-Methyl-4-ethylbenzene (PETOL) | 0.37 | 0.34 | 0.38 |
| 1,3,5-Trimethylbenzene | 0.23 | 0.21 | 0.24 |
| 5-Methylnonane | 0.12 | 0.13 | 0.10 |
| 4-Methylnonane | 0.24 | 0.26 | 0.21 |
| 1-Methyl-2-ethylbenzene (OETOL) | 0.41 | 0.36 | 0.41 |
| 3-Methylnonane | 0.53 | 0.56 | 0.45 |
| 1,2,4-Trimethylbenzene | 0.61 | 0.55 | 0.58 |
| C10 Naphthene | 2.67 | 2.64 | 2.31 |
| Isobutylbenzene | 0.27 | 0.24 | 0.24 |
| N-Decane/Sec-butylbenzene | 0.58 | 0.62 | 0.50 |
| 1,2,3-TrimethylBZ/1-M-3-isopropylBZ | 0.31 | 0.27 | 0.32 |
| 1-Methyl-4-isopropylbenzene | 0.13 | 0.11 | 0.11 |
| Indane (2,3-Dihydroindene) | 0.44 | 0.35 | 0.45 |
| Butylcyclohexane | 0.30 | 0.29 | 0.26 |
| 1-Methyl-2-isopropylbenzene | 0.35 | 0.31 | 0.31 |
| 1,3-Diethylbenzene | 0.14 | 0.12 | 0.12 |
| 1-Methyl-3-n-propylbenzene | 0.41 | 0.37 | 0.37 |
| 1,4-Diethylbenzene | 0.52 | 0.47 | 0.47 |
| N-Butylbenzene/1-Methyl-4-n-propylBZ | 0.26 | 0.23 | 0.23 |
| 1,2-Diethylbenzene | 0.08 | 0.07 | 0.07 |
| 1,3-Dimethyl-2-ethylbenzene | 0.21 | 0.19 | 0.19 |
| 1-Methyl-2-n-propylbenzene | 0.39 | 0.34 | 0.35 |
| 4-Methyldecane | 0.21 | 0.21 | 0.16 |
| 1,4-Dimethyl-2-ethylbenzene | 0.27 | 0.24 | 0.24 |
| 1,3-Dimethyl-4-ethylbenzene | 0.25 | 0.22 | 0.23 |
| 3-Methyldecane | 0.19 | 0.20 | 0.15 |
| 1,2-Dimethyl-4-ethylbenzene | 0.25 | 0.23 | 0.23 |
| 1-Methyl-4-terbutylbenzene | 0.26 | 0.23 | 0.23 |
| 4-Methylindane | 0.41 | 0.36 | 0.37 |
| 1,2-Dimethyl-3-Ethylbenzene | 0.35 | 0.31 | 0.32 |
| 1,2,4,5-Tetramethylbenzene (Durene) | 0.25 | 0.22 | 0.23 |
| N-Undecane | 0.49 | 0.51 | 0.38 |
| C11 Aromatics | 4.26 | 3.70 | 3.49 |
| 1,2,3,5-Tetramethylbenzene (Isodurene) | 0.34 | 0.29 | 0.30 |
| 1,2,3,4-Tetramethylbenzene (Prehnitene) | 0.38 | 0.32 | 0.34 |
| Pentylbenzene | 0.22 | 0.19 | 0.18 |
| 5-Methylindane | 0.16 | 0.13 | 0.14 |
| Naphthalene | 0.25 | 0.21 | 0.24 |
| N-Dodecane | 0.36 | 0.37 | 0.25 |
| 2-Methylnaphthalene | 0.42 | 0.34 | 0.36 |
| 1-Methylnaphthalene | 0.41 | 0.34 | 0.35 |
| C-12 thru C-13 | 5.41 | 5.42 | 3.62 |
| N-Tridecane | 0.36 | 0.31 | 0.23 |
| C-13 thru C-14 | 5.98 | 5.20 | 3.54 |
| N-Tetradecane | 0.54 | 0.47 | 0.31 |
| C-14 plus | 5.84 | 4.57 | 2.83 |
| Unidentified | 9.10 | 8.90 | 7.35 |
| | 100.00 | 100.00 | 100.00 |

| | Paraffin | Isopara. | Olefins | Naphth. | Aromatic |
|---|---|---|---|---|---|
| C4 | 1.69 | 0.56 | 0.00 | | |
| C5 | 2.29 | 2.50 | 0.00 | 0.41 | |
| C6 | 2.15 | 4.30 | 0.00 | 3.37 | 0.21 |
| C7 | 1.37 | 3.80 | 0.00 | 5.92 | 0.53 |
| C8 | 1.31 | 3.55 | 0.00 | 7.23 | 2.31 |
| C9 | 0.78 | 2.81 | | 7.70 | 2.78 |

-continued

Untreated Feed

| | | | | | |
|---|---|---|---|---|---|
| C10 | 0.62 | 2.56 | | 2.94 | 4.64 |
| C11 | 0.51 | 0.41 | | | 5.16 |
| Total LV % | 10.73 | 20.48 | 0.00 | 27.56 | 15.63 |
| Unidentified | 25.60 | | | | |
| Mol Wt of Sample | | 121.3 | | | |
| Mol Wt C6 Plus | | 127.9 | | | |
| Density of Sample | | 0.7826 | | | |
| Density C6 Plus | | 0.7962 | | | |

Calcium Oxide/Catalyst Treated

| Component Name | Wt. % | LV. % | Mole % |
|---|---|---|---|
| Propane | 0.36 | 0.51 | 0.77 |
| Isobutane | 0.67 | 0.85 | 1.08 |
| N-Butane | 2.88 | 3.51 | 4.66 |
| 2,2-Dimethylpropane | 0.03 | 0.04 | 0.05 |
| Isopentane | 4.98 | 5.52 | 6.49 |
| N-Pentane | 6.44 | 7.26 | 8.38 |
| 2,2-Dimethylbutane | 0.23 | 0.25 | 0.25 |
| Cyclopentane | 1.03 | 0.98 | 1.38 |
| 2,3-Dimethylbutane | 1.31 | 1.40 | 1.43 |
| 2-Methylpentane | 4.53 | 4.90 | 4.94 |
| 3-Methylpentane | 4.16 | 4.43 | 4.54 |
| N-Hexane | 7.08 | 7.59 | 7.72 |
| 2,2-Dimethylpentane | 0.15 | 0.15 | 0.17 |
| Methylcyclopentane | 4.39 | 4.15 | 4.90 |
| 2,4-Dimethylpentane. | 0.46 | 0.48 | 0.43 |
| 2,3,3-Trimethylbutane | 0.07 | 0.07 | 0.07 |
| Benzene | 0.63 | 0.50 | 0.75 |
| 3,3-Dimethylpentane | 0.12 | 0.13 | 0.11 |
| Cyclohexane | 2.90 | 2.78 | 2.95 |
| 2-Methylhexane | 1.99 | 2.07 | 1.86 |
| 2,3-Dimethylpentane | 1.50 | 1.52 | 1.40 |
| 1,1-Dimethylcyclopentane | 0.40 | 0.38 | 0.38 |
| 3-Methylhexane | 3.44 | 3.54 | 3.23 |
| Cis-1,3-dimethylcyclopentane | 1.16 | 1.10 | 1.11 |
| Trans-1,3-dimethylcyclopentane. | 1.08 | 1.02 | 1.03 |
| 3-Ethylpentane | 0.50 | 0.53 | 0.47 |
| Trans-1,2-dimethylcyclopentane | 2.09 | 1.96 | 2.00 |
| 2,2,4-Trimethylpentane | 0.02 | 0.01 | 0.01 |
| N-Heptane | 4.08 | 4.22 | 3.83 |
| Methylcyclohexane | 4.92 | 4.51 | 4.71 |
| 1,1,3-Trimethylcyclopentane | 0.40 | 0.037 | 0.34 |
| Ethylcyclopentane | 0.99 | 0.91 | 0.095 |
| 2,5-Dimethylhexane | 0.33 | 0.34 | 0.27 |
| 2,4-Dimethylhexane | 0.55 | 0.55 | 0.45 |
| Trans, cis-1,2,4-trimethylcyclopentane | 0.72 | 0.70 | 0.59 |
| 3,3-Dimethylhexane | 0.09 | 0.09 | 0.08 |
| Trans, cis-1,2,3-trimethylcyclopentane | 0.9 1 | 0.86 | 0.76 |
| 2,3,4-Trimethylpentane | 0.23 | 0.22 | 0.19 |
| Toluene | 1.49 | 1.22 | 1.52 |
| 2-Methyl-3-Ethylpentane | 0.21 | 0.21 | 0.17 |
| 2-Methylheptane | 1.53 | 1.55 | 1.26 |
| 4-Methylheptane | 0.71 | 0.71 | 0.58 |
| 3,4-Dimethylhexane | 0.12 | 0.12 | 0.10 |
| Cis,trans, 1,2,4-trimethylcyclopentane | 0.09 | 0.08 | 0.07 |
| 3-MethylC7 + Cis, trans, 1,2, 3-Trimethy | 1.22 | 1.23 | 1.01 |
| Trans-1,4-dimethylcyclohexane | 1.67 | 1.55 | 1.40 |
| 1,1-Dimethylcyclohexane | 0.59 | 0.53 | 0.49 |
| 3-Ethylhexane | 0.34 | 0.33 | 0.28 |
| Trans-1-ethyl-3-methylcyclopentane | 0.36 | 0.33 | 0.30 |
| Cis-1-ethyl-3-methylcyclopentane | 0.32 | 0.29 | 0.26 |
| Trans-1-ethyl-2-methylcyclopentane | 0.80 | 0.74 | 0.67 |
| 1-Ethyl-1-methylcyclopentane | 0.05 | 0.05 | 0.04 |
| Trans-1,2, dimethylcyclohexane | 0.81 | 0.74 | 0.68 |
| 2,2,4-Trimethylhexane | 0.04 | 0.04 | 0.03 |
| 1,1,2-trimethylcyclopentane | 0.68 | 0.61 | 0.57 |
| Trans-1,3-dimethylcyclohexane | 0.01 | 0.01 | 0.01 |
| N-Octane | 2.00 | 2.02 | 1.65 |
| Isopropylcyclopentane | 0.21 | 0.19 | 0.18 |
| Cis-1-ethyl-2-methylcyclopentane | 0.09 | 0.08 | 0.07 |
| Cis-1, 2-dimethylcyclohexane | 0.39 | 0.34 | 0.32 |
| 4,4-Dimethylheptane | 0.02 | 0.02 | 0.01 |

-continued

Calcium Oxide/Catalyst Treated

| | | | |
|---|---|---|---|
| n-Propylcyclopentane | 0.05 | 0.04 | 0.04 |
| 2,6-Dimethylheptane | 0.53 | 0.53 | 0.39 |
| 1,1,3-Trimethylcyclohexane | 1.78 | 1.62 | 1.32 |
| Ethylcyclohexane | 1.20 | 1.09 | 0.89 |
| 2,5-Dimethylheptane | 0.48 | 0.47 | 0.35 |
| 3,5-Dimethylheptane | 0.09 | 0.09 | 0.07 |
| Ethylbenzene | 0.53 | 0.43 | 0.47 |
| Cis, trans, 1,3,5-trimethylcyclohexane | 0.29 | 0.27 | 0.22 |
| Meta-Xylene | 0.53 | 0.44 | 0.47 |
| Para-Xylene | 0.59 | 0.49 | 0.52 |
| 2,3-Dimethylheptane | 0.06 | 0.05 | 0.04 |
| C9 Naphthene | 2.02 | 1.84 | 1.50 |
| 4-Ethylheptane | 0.16 | 0.15 | 0.11 |
| 4-Methyloctane | 0.27 | 0.26 | 0.20 |
| 2-Methyloctane | 0.25 | 0.25 | 0.18 |
| 3-Ethylheptane | 0.09 | 0.09 | 0.07 |
| 3-Methyloctane | 0.59 | 0.59 | 0.43 |
| Ortho-Xylene | 0.52 | 0.42 | 0.46 |
| C10 Paraffin | 0.14 | 0.14 | 0.11 |
| 1-Methyl-2-propycyclopentane | 0.38 | 0.34 | 0.29 |
| Cis-1-ethyl-3-methylcyclohexane | 0.30 | 0.26 | 0.22 |
| Trans-1-ethyl-4-methylcyclohexane | 0.21 | 0.19 | 0.16 |
| N-Nonane | 0.65 | 0.64 | 0.47 |
| Trans-1-ethyl-3-methylcyclohexane | 0.25 | 0.23 | 0.19 |
| 1-Ethyl-1-methylcyclohexane | 0.07 | 0.06 | 0.05 |
| Isopropylbenzene | 0.08 | 0.06 | 0.06 |
| Isopropylcyclohexane | 0.17 | 0.15 | 0.13 |
| N-propylcyclohexane | 0.08 | 0.07 | 0.06 |
| N-butylcyclopentane | 0.31 | 0.28 | 0.23 |
| 3,3-Dimethyloctane | 0.20 | 0.20 | 0.13 |
| n-Propylbenzene | 0.17 | 0.14 | 0.13 |
| 1-Methyl-3-ethylbenzene (METOL) | 0.13 | 0.11 | 0.10 |
| 1-Methyl-4-ethylbenzene (PETOL) | 0.13 | 0.11 | 0.10 |
| 1,3,5-Trimethylbenzene | 0.09 | 0.08 | 0.07 |
| 5-Methylnonane | 0.05 | 0.05 | 0.04 |
| 4-Methylnonane | 0.14 | 0.13 | 0.09 |
| 1-Methyl-2-ethylbenzene (OETOL) | 0.15 | 0.12 | 0.11 |
| 3-Methylnonane | 0.14 | 0.13 | 0.09 |
| 1,2,4-Trimethylbenzene | 0.26 | 0.21 | 0.19 |
| C10 Naphthene | 0.84 | 0.76 | 0.57 |
| Isobutylbenzene | 0.03 | 0.03 | 0.02 |
| N-Decane/Sec-butylbenzene | 0.21 | 0.20 | 0.14 |
| 1,2,3-TrimethylBZ/1-M-3-isopropylBZ | 0.10 | 0.08 | 0.08 |
| 1-Methyl-4-isopropylbenzene | 0.03 | 0.03 | 0.02 |
| Indane (2,3-Dihydroindene) | 0.10 | 0.07 | 0.08 |
| Butylcyclohexane | 0.06 | 0.05 | 0.04 |
| 1-Methyl-2-isopropylbenzene | 0.07 | 0.06 | 0.05 |
| 1,3-Diethylbenzene | 0.02 | 0.02 | 0.01 |
| 1-Methyl-3-n-propylbenzene | 0.11 | 0.09 | 0.07 |
| 1,4-Diethylbenzene | 0.09 | 0.08 | 0.07 |
| N-Butylbenzene/1-Methyl-4-n-propylBZ | 0.04 | 0.04 | 0.03 |
| 1,2-Diethylbenzene | 0.01 | 0.01 | 0.01 |
| 1,3-Dimethyl-2-ethylbenzene | 0.02 | 0.02 | 0.01 |
| 1-Methyl-2-n-propylbenzene | 0.06 | 0.05 | 0.04 |
| 4-Methyldecane | 0.03 | 0.03 | 0.02 |
| 1,4-Dimethyl-2-ethylbenzene | 0.04 | 0.03 | 0.03 |
| 1,3-Dimethyl-4-ethylbenzene | 0.03 | 0.03 | 0.02 |
| 3-Methyldecane | 0.03 | 0.03 | 0.02 |
| 1,2-Dimethyl-4-ethylbenzene | 0.03 | 0.03 | 0.02 |
| 1-Methyl-4-terbutylbenzene | 0.05 | 0.04 | 0.04 |
| 1,2,4,5-Tetramethylbenzene (Durene) | 0.02 | 0.01 | 0.01 |
| N-Undecane | 0.07 | 0.06 | 0.04 |
| C11 Aromatics | 0.06 | 0.04 | 0.03 |
| 1,2,3,5-Tetramethylbenzene (Isodurene) | 0.02 | 0.02 | 0.01 |
| 1,2,3,4-Tetramethylbenzene (Prehnitene) | 0.01 | 0.01 | 0.01 |
| Naphthalene | 0.01 | 0.01 | 0.01 |
| Unidentified | 2.12 | 1.88 | 1.32 |
| | 100.00 | 100.00 | 100.00 |

| | Paraffin | Isopara. | Olefins | Naphth. | Aromatic |
|---|---|---|---|---|---|
| C4 | 3.51 | 0.85 | 0.00 | | |
| C5 | 7.26 | 5.55 | 0.00 | 0.98 | |
| C6 | 7.59 | 10.98 | 0.00 | 6.93 | 0.50 |
| C7 | 4.22 | 8.49 | 0.00 | 9.89 | 1.22 |
| C8 | 2.02 | 5.02 | 0.00 | 8.62 | 1.78 |
| C9 | 0.64 | 2.87 | | 5.30 | 0.97 |

-continued

| Calcium Oxide/Catalyst Treated | | | | | |
|---|---|---|---|---|---|
| C10 | 0.20 | 0.66 | | 0.81 | 0.54 |
| C11 | 0.06 | 0.06 | | | 0.09 |
| Total LV % | 25.50 | 34.48 | 0.00 | 32.53 | 5.10 |
| Unidentified | 2.39 | | | | |
| Mol Wt of Sample | | 93.9 | | | |
| Mol Wt C6 Plus | | 101.2 | | | |
| Density of Sample | | 0.7118 | | | |
| Density C6 Plus | | 0.7318 | | | |

| Dolomitic Oxide/catalyst Treated | | | |
|---|---|---|---|
| Component Name | Wt. % | LV. % | Mole % |
| Propane | 0.36 | 0.52 | 0.84 |
| Isobutane | 0.51 | 0.66 | 0.89 |
| N-Butane | 2.00 | 2.52 | 3.51 |
| 2,2-Dimethylpropane | 0.02 | 0.03 | 0.04 |
| Isopentane | 3.00 | 3.44 | 4.25 |
| N-Pentane | 3.80 | 4.44 | 5.38 |
| 2,2-Dimethylbutane | 0.14 | 0.15 | 0.16 |
| Cyclopentane | 0.61 | 0.60 | 0.89 |
| 2,3-Dimethylbutane | 0.79 | 0.87 | 0.93 |
| 2-Methylpentane | 2.70 | 3.02 | 3.20 |
| 3-Methylpentane | 2.52 | 2.77 | 2.98 |
| N-Hexane | 4.35 | 4.82 | 5.16 |
| 2,2-Dimethylpentane | 0.10 | 0.10 | 0.12 |
| Methylcyclopentane | 2.80 | 2.73 | 3.40 |
| 2,4-Dimethylpentane | 0.31 | 0.34 | 0.31 |
| 2,3,3-Trimethylbutane | 0.05 | 0.05 | 0.05 |
| Benzene | 0.40 | 0.34 | 0.53 |
| 3,3-Dimethylpentane | 0.09 | 0.09 | 0.09 |
| Cyclohexane | 1.94 | 1.93 | 2.15 |
| 2-Methylhexane | 1.41 | 1.51 | 1.43 |
| 2,3-Dimethylpentane | 1.06 | 1.12 | 1.08 |
| 1,1-Dimethylcyclopentane | 0.28 | 0.27 | 0.29 |
| 3-Methylhexane | 2.48 | 2.64 | 2.53 |
| Cis-1,3-dimethylcyclopentane | 0.84 | 0.82 | 0.87 |
| Trans-1,3-dimethylcyclopentane | 0.78 | 0.76 | 0.81 |
| 3-Ethylpentane | 0.37 | 0.40 | 0.37 |
| Trans-1,2-dimethylcyclopentane | 1.52 | 1.47 | 1.58 |
| 2,2,4-Trimethylpentane | 3.17 | 3.39 | 3.23 |
| N-Heptane | 3.17 | 3.39 | 3.23 |
| Methylcyclohexane | 3.98 | 3.78 | 4.14 |
| 1,1,3-Trimethylcyclopentane | 0.34 | 0.32 | 0.31 |
| Ethylcyclopentane | 0.83 | 0.79 | 0.86 |
| 2,5-Dimethylhexane | 0.29 | 0.31 | 0.26 |
| 2,4-Dimethylhexane | 0.48 | 0.50 | 0.43 |
| Trans, cis-1,2,4-trimethylcyclopentane | 0.64 | 0.64 | 0.58 |
| 3,3-Dimethylhexane | 0.09 | 0.09 | 0.08 |
| Trans, cis-1,2,3-trimethylcyclopentane | 0.83 | 0.80 | 0.75 |
| 2,3,4-Trimethylpentane | 0.21 | 0.21 | 0.19 |
| Toluene | 1.29 | 1.09 | 1.43 |
| 2-Methyl-3-Ethylpentane | 0.20 | 0.021 | 0.18 |
| 2-Methylheptane | 1.54 | 1.61 | 1.38 |
| 4-Methylheptane | 0.72 | 0.74 | 0.64 |
| 3,4-Dimethylhexane | 0.12 | 0.12 | 0.10 |
| Cis,trans, 1,2,4-trimethylcyclopentane | 0.09 | 0.08 | 0.08 |
| 3-MethylC7 + Cis, trans, 1,2,3-Trimethy | 1.30 | 1.34 | 1.16 |
| Trans-1,4-dimethylcyclohexane | 1.70 | 1.63 | 1.55 |
| 1,1-Dimethylcyclohexane | 6.12 | 5.73 | 5.57 |
| 3-Ethylhexane | 0.35 | 0.36 | 0.31 |
| Trans-1-ethyl-3-methylcyclopentane | 0.39 | 0.36 | 0.35 |
| Cis-1-ethyl-3-methylcyclopentane | 0.34 | 0.32 | 0.31 |
| Trans-1-ethyl-2-methylcyclopentane | 0.85 | 0.82 | 0.78 |
| 1-Ethyl-1-methylcyclopentane | 0.06 | 0.05 | 0.05 |
| Trans-1,2,dimethylcyclohexane | 0.90 | 0.85 | 0.82 |
| 2,2,4-Trimethylhexane | 0.05 | 0.05 | 0.04 |
| 1,1,2-trimethylcyclopentane | 0.65 | 0.61 | 0.59 |
| Trans-1,3-dimethylcyclohexane | 0.02 | 0.01 | 0.01 |
| N-Octane | 2.33 | 2.42 | 2.08 |
| Isopropylcyclopentane | 0.25 | 0.24 | 0.23 |
| Cis-1-ethyl-2-methylcyclopentane | 0.10 | 0.10 | 0.09 |
| Cis-1,2-dimethylcyclohexane | 0.50 | 0.46 | 0.46 |
| 4,4-Dimethylheptane | 0.03 | 0.03 | 0.02 |

-continued

| Dolomitic Oxide/catalyst Treated | | | |
|---|---|---|---|
| n-Propylcyclopentane | 0.06 | 0.06 | 0.06 |
| 2,6-Dimethylheptane | 0.73 | 0.75 | 0.58 |
| 1,1,3-Trimethylcyclohexane | 2.44 | 2.30 | 1.98 |
| Ethylcyclohexane | 1.54 | 1.44 | 1.25 |
| 2,5-Dimethylheptane | 0.66 | 0.67 | 0.52 |
| 3,5-Dimethylheptane | 0.13 | 0.13 | 0.10 |
| Ethylbenzene | 0.69 | 0.58 | 0.66 |
| Cis,trans,1,3,5trimethylcyclohexane | 0.43 | 0.41 | 0.35 |
| Meta-Xylene | 0.74 | 0.63 | 0.71 |
| Para-Xylene | 0.85 | 0.73 | 0.82 |
| 2,3-Dimethylheptane | 0.08 | 0.08 | 0.06 |
| C9 Naphthene | 3.27 | 3.07 | 2.64 |
| 4-Ethylheptane | 0.24 | 0.24 | 0.19 |
| 4-Methyloctane | 0.43 | 0.44 | 0.34 |
| 2-Methyloctane | 0.40 | 0.41 | 0.32 |
| 3-Methyloctane | 1.12 | 1.15 | 0.89 |
| Ortho-Xylene. | 0.81 | 0.67 | 0.78 |
| C10 Paraffin | 0.50 | 0.51 | 0.40 |
| 1-Methyl-2-propylcyclopentane | 0.67 | 0.61 | 0.54 |
| Cis-1-ethyl-3-methylcyclohexane | 0.51 | 0.46 | 0.41 |
| Trans-1-ethyl-4-methylcyclohexane | 0.36 | 0.33 | 0.29 |
| N-Nonane | 1.24 | 1.26 | 0.99 |
| Trans-1-ethyl-3-methylcyclohexane | 0.47 | 0.44 | 0.38 |
| 1-Ethyl-1-methylcyclohexane | 0.12 | 0.11 | 0.10 |
| Isopropylbenzene | 0.14 | 0.11 | 0.11 |
| Isopropylcyclohexane | 0.34 | 0.32 | 0.28 |
| N-propylcyclohexane | 0.17 | 0.16 | 0.14 |
| N-butylcyclopentane | 0.66 | 0.62 | 0.54 |
| 3,6-Dimethyloctane | 0.45 | 0.46 | 0.33 |
| 3,3-Dimethyloctane | 0.96 | 0.97 | 0.69 |
| n-Propylbenzene | 0.39 | 0.33 | 0.33 |
| 1-Methyl-3-ethylbenzene (METOL) | 0.31 | 0.26 | 0.26 |
| 1-Methyl-4-ethylbenzene (PETOL) | 0.37 | 0.31 | 0.31 |
| 1,3,5-Trimethylbenzene | 0.21 | 0.18 | 0.18 |
| 5-Methylnonane | 0.14 | 0.14 | 0.10 |
| 4-Methylnonane | 0.36 | 0.36 | 0.26 |
| 1-Methyl-2-ethylbenzene (OETOL) | 0.34 | 0.29 | 0.29 |
| 3-Methylnonane | 0.60 | 0.60 | 0.43 |
| 1,2,4-Trimethylbenzene | 0.68 | 0.57 | 0.55 |
| C10 Naphthene | 2.24 | 2.08 | 1.63 |
| Isobutylbenzene | 0.10 | 0.08 | 0.08 |
| N-Decane/Sec-butylbenzene | 0.65 | 0.65 | 0.47 |
| 1,2,3-TrimethylBZ/1-M-3-isopropylBZ | 0.30 | 0.025 | 0.26 |
| 1-Methyl-4-isopropylbenzene | 0.11 | 0.10 | 0.09 |
| Indane (2,3-Dihydroindene) | 0.36 | 0.27 | 0.31 |
| Butylcyclohexane | 0.22 | 0.20 | 0.16 |
| 1-Methyl-2-isopropylbenzene | 0.28 | 0.24 | 0.21 |
| 1,3-Diethylbenzene | 0.09 | 0.08 | 0.07 |
| 1-Methyl-3-n-propylbenzene | 0.40 | 0.34 | 0.31 |
| 1,4-Diethylbenzene | 0.36 | 0.30 | 0.27 |
| N-Butylbenzene/1-Methyl-4-n-propylBZ | 0.18 | 0.15 | 0.14 |
| 1,2-Diethylbenzene | 0.06 | 0.05 | 0.05 |
| 1,3-Dimethyl-2-ethylbenzene | 0.11 | 0.09 | 0.08 |
| 1-Methyl-2-n-propylbenzene | 0.25 | 0.21 | 0.19 |
| 4-Methyldecane | 0.14 | 0.14 | 0.09 |
| 1,4-Dimethyl-2-ethylbenzene | 0.16 | 0.14 | 0.12 |
| 1,3-Dimethyl-4-ethylbenzene | 0.16 | 0.13 | 0.12 |
| 3-Methyldecane | 0.16 | 0.15 | 0.10 |
| 1,2-Dimethyl-4-ethylbenzene | 0.16 | 0.13 | 0.12 |
| 1-Methyl-4-terbutylbenzene | 0.29 | 0.24 | 0.22 |
| 1,2,4,5-Tetramethylbenzene (Durene) | 0.12 | 0.09 | 0.09 |
| N-Undecane | 0.31 | 0.30 | 0.20 |
| C11 Aromatics | 0.96 | 0.79 | 0.66 |
| 1,2,3,5-Tetramethylbenzene (Isodurene) | 0.14 | 0.11 | 0.10 |
| 1,2,3,4-Tetramethylbenzene (Prehnitene) | 0.12 | 0.10 | 0.09 |
| Pentylbenzene | 0.04 | 0.03 | 0.02 |
| Naphthalene | 0.06 | 0.05 | 0.05 |
| N-Dodecane | 0.06 | 0.06 | 0.04 |
| 2-Methylnaphthalene | 0.05 | 0.04 | 0.04 |
| 1 Methylnaphthalene | 0.02 | 0.01 | 0.01 |
| N-Tridecane | 0.03 | 0.02 | 0.01 |
| Unidentified | 0.78 | 0.71 | 0.53 |
| | 100.00 | 100.00 | 100.00 |

-continued

Dolomitic Oxide/catalyst Treated

| | Paraffin | Isopara. | Olefins | Naphth. | Aromatic |
|---|---|---|---|---|---|
| C4 | 2.52 | 0.66 | 0.00 | | |
| C5 | 4.44 | 3.46 | 0.00 | 0.60 | |
| C6 | 4.82 | 6.81 | 0.00 | 4.67 | 0.34 |
| C7 | 3.39 | 6.25 | 0.00 | 7.90 | 1.09 |
| C8 | 2.42 | 5.13 | 0.00 | 14.54 | 2.61 |
| C9 | 1.26 | 4.30 | | 8.83 | 2.58 |
| C10 | 0.65 | 3.03 | | 2.29 | 2.40 |
| C11 | 0.30 | 0.29 | | | 1.11 |
| Total LV % | 19.80 | 29.94 | 0.00 | 38.82 | 10.12 |
| Unidentified | 1.32 | | | | |
| Mol Wt of Sample | | 102.1 | | | |
| Mol Wt C6 Plus | | 108.4 | | | |
| Density of Sample | | 0.7359 | | | |
| Density C6 Plus | | 0.7518 | | | |

Comparison Data of the Three Analysis

| Component Name | Un-treated Feed Mole % | Calcium Oxide Mole % | Dolo-mitic Oxide Mole % |
|---|---|---|---|
| Propane | 0.64 | 0.77 | 0.84 |
| Isobutane | 0.83 | 1.08 | 0.89 |
| N-Butane | 2.63 | 4.66 | 3.51 |
| 2,2-Dimethylpropane | 0.05 | 0.05 | 0.04 |
| Isopentane | 3.42 | 6.49 | 4.25 |
| N-Pentane | 3.10 | 8.38 | 5.38 |
| 2,2-Dimethylbutane | 0.21 | 0.25 | 0.16 |
| Cyclopentane | 0.69 | 1.38 | 0.89 |
| 2,3-Dimethylbutane | 0.82 | 1.43 | 0.93 |
| 2-Methylpentane | 2.09 | 4.94 | 3.20 |
| 3-Methylpentane | 2.01 | 4.54 | 2.98 |
| N-Hexane | 2.57 | 7.72 | 5.16 |
| 2,2-Dimethylpentane | 0.14 | 0.17 | 0.12 |
| Methylcyclopentane | 2.52 | 4.90 | 3.40 |
| 2,4-Dimethylpentane | 0.30 | 0.43 | 0.31 |
| 2,3,3-Trimethylbutane | 0.06 | 0.07 | 0.05 |
| Benzene | 0.37 | 0.75 | 0.53 |
| 3,3-Dimethylpentane | 0.09 | 0.11 | 0.09 |
| Cyclohexane | 1.93 | 2.95 | 2.15 |
| 2-Methylhexane | 0.79 | 1.86 | 1.43 |
| 2,3-Dimethylpentane | 0.90 | 1.40 | 1.08 |
| 1,1-Dimethylcyclopentane | 0.34 | 0.38 | 0.29 |
| 3-Methylhexane | 1.52 | 3.23 | 2.53 |
| Cis-1,3-dimethylcyclopentane | 0.76 | 1.11 | 0.87 |
| Trans-1,3-dimethylcyclopentane | 0.71 | 1.03 | 0.81 |
| 3-Ethylpentane | 0.28 | 0.47 | 0.37 |
| Trans-1,2-dimethylcyclopentane | 1.15 | 2.00 | 1.58 |
| 2,2,4-Trimethylpentane | 0.00 | 0.01 | 0.00 |
| N-Heptane | 1.46 | 3.83 | 3.23 |
| Methylcyclohexane | 3.66 | 4.71 | 4.14 |
| 1,1,3-Trimethylcyclopentane | 0.36 | 0.34 | 0.31 |
| Ethylcyclopentane | 0.53 | 0.95 | 0.86 |
| 2,5-Dimethylhexane | 0.20 | 0.27 | 0.26 |
| 2,4-Dimethylhexane | 0.35 | 0.45 | 0.43 |
| Trans, cis-1,2,4-trimethylcyclopentane | 0.51 | 0.59 | 0.58 |
| 3,3-Dimethylhexane | 0.08 | 0.08 | 0.08 |
| Trans, cis-1,2,3-trimethylcyclopentane | 0.66 | 0.76 | 0.75 |
| 2,3,4-Trimethylpentane | 0.16 | 0.19 | 0.19 |
| Toluene | 0.77 | 1.52 | 1.43 |
| 2-Methyl-3-Ethylpentane | 0.15 | 0.17 | 0.18 |
| 2-Methylheptane | 0.62 | 1.26 | 1.38 |
| 4-Methylheptane | 0.44 | 0.58 | 0.64 |
| 3,4-Dimethylhexane | 0.09 | 0.10 | 0.10 |
| Cis,trans, 1,2,4-trimethylcyclopentane | 0.08 | 0.07 | 0.08 |
| 3-MethylC7 + Cis, trans,1,2, 3-Trimethy | 1.33 | 1.01 | 1.16 |
| Trans-1,4-dimethylcyclohexane | 0.90 | 1.40 | 1.55 |
| 1,1-Dimethylcyclohexane | 0.59 | 0.49 | 5.57 |
| 3-Ethylhexane | 0.32 | 0.28 | 0.31 |
| Trans-1-ethyl-3-methylcyclopentane | 0.25 | 0.30 | 0.35 |
| Cis-1-ethyl-3-methylcyclopentane | 0.23 | 0.26 | 0.31 |

-continued

Comparison Data of the Three Analysis

| Component Name | Un-treated Feed Mole % | Calcium Oxide Mole % | Dolo-mitic Oxide Mole % |
|---|---|---|---|
| Trans-1-ethyl-2-methylcyclopentane | 0.58 | 0.67 | 0.78 |
| 1-Ethyl-1-methylcyclopentane | 0.06 | 0.04 | 0.05 |
| Trans-1,2, dimethylcyclohexane | 0.89 | 0.68 | 0.82 |
| 2,2,4-Trimethylhexane | 0.04 | 0.03 | 0.04 |
| 1,1,2-trimethylcyclopentane | 0.50 | 0.57 | 0.59 |
| Trans-1,3-dimethylcyclohexane | 0.01 | 0.01 | 0.01 |
| N-Octane | 1.25 | 1.65 | 2.08 |
| Isopropylcyclopentane | 0.18 | 0.18 | 0.23 |
| Cis-1-ethyl-2-methylcyclopentane | 0.08 | 0.07 | 0.09 |
| Cis-1,2-dimethylcyclohexane | 0.45 | 0.32 | 0.46 |
| 4,4-Dimethylheptane | 0.02 | 0.01 | 0.02 |
| n-Propylcyclopentane | 0.06 | 0.04 | 0.06 |
| 2,6-Dimethylheptane | 0.32 | 0.39 | 0.58 |
| 1,1,3-Trimethylcyclohexane | 1.78 | 1.32 | 1.98 |
| Ethylcyclohexane | 1.19 | 0.89 | 1.25 |
| 2,5-Dimethylheptane | 0.46 | 0.35 | 0.52 |
| 3,5-Dimethylheptane | 0.10 | 0.07 | 0.10 |
| Ethylbenzene | 0.94 | 0.47 | 0.66 |
| Cis, trans, 1,3,5-trimethylcyclohexane | 0.40 | 0.22 | 0.35 |
| Meta-Xylene | 0.52 | 0.47 | 0.71 |
| Para-Xylene | 0.76 | 0.52 | 0.82 |
| 2,3-Dimethylheptane | 0.06 | 0.04 | 0.06 |
| C9 Naphthene | 2.20 | 1.50 | 2.64 |
| 4-Ethylheptane | 0.17 | 0.11 | 0.19 |
| 4-Methyloctane | 0.21 | 0.20 | 0.34 |
| 2-Methyloctane | 0.16 | 0.18 | 0.32 |
| 3-Ethylheptane | 0.00 | 0.07 | 0.00 |
| 3-Methyloctane | 0.61 | 0.43 | 0.89 |
| Ortho-Xylene | 0.72 | 0.46 | 0.78 |
| C10 Paraffin | 0.52 | 0.11 | 0.40 |
| 1-Methyl-2-propylcyclopentane | 0.54 | 0.29 | 0.54 |
| Cis-1-ethyl-3-methylcyclohexane | 0.46 | 0.22 | 0.41 |
| Trans-1-ethyl-4-methylcyclohexane | 0.35 | 0.16 | 0.29 |
| N-Nonane | 0.68 | 0.47 | 0.99 |
| Trans-1-ethyl-3-methylcyclohexane | 0.48 | 0.19 | 0.38 |
| 1-Ethyl-1-methylcyclohexane | 0.13 | 0.05 | 0.10 |
| Isopropylbenzene | 0.15 | 0.06 | 0.11 |
| Isopropylcyclohexane | 0.34 | 0.13 | 0.28 |
| N-propylcyclohexane | 0.15 | 0.06 | 0.14 |
| N-butylcyclopentane | 0.62 | 0.23 | 0.54 |
| 3,6-Dimethyloctane | 0.40 | 0.00 | 0.33 |
| 3,3-Dimethyloctane | 0.41 | 0.13 | 0.69 |
| n-Propylbenzene | 0.38 | 0.13 | 0.33 |
| 1-Methyl-3-ethylbenzene (METOL) | 0.25 | 0.10 | 0.26 |
| 1-Methyl-4-ethylbenzene (PETOL) | 0.38 | 0.10 | 0.31 |
| 1,3,5-Trimethylbenzene | 0.24 | 0.07 | 0.18 |
| 5-Methylnonane | 0.10 | 0.04 | 0.10 |
| 4-Methylnonane | 0.21 | 0.09 | 0.26 |
| 1-Methyl-2-ethylbenzene (OETOL) | 0.41 | 0.11 | 0.29 |
| 3-Methylnonane | 0.45 | 0.09 | 0.43 |
| 1,2,4-Trimethylbenzene | 0.58 | 0.19 | 0.55 |
| C10 Naphthene | 2.31 | 0.57 | 1.63 |
| Isobutylbenzene | 0.24 | 0.02 | 0.08 |
| N-Decane/Sec-butylbenzene | 0.50 | 0.14 | 0.47 |
| 1,2,3-TrimethylBZ/1-M-3-isopropylBZ | 0.32 | 0.08 | 0.26 |
| 1-Methyl-4-isopropylbenzene | 0.11 | 0.02 | 0.09 |
| Indane (2,3-Dihydroindene) | 0.45 | 0.08 | 0.31 |
| Butylcyclohexane | 0.26 | 0.04 | 0.16 |
| 1-Methyl-2-isopropylbenzene | 0.31 | 0.05 | 0.21 |
| 1,3-Diethylbenzene | 0.12 | 0.01 | 0.07 |
| 1-Methyl-3-n-propylbenzene | 0.37 | 0.07 | 0.31 |
| 1,4-Diethylbenzene | 0.47 | 0.07 | 0.27 |
| N-Butylbenzene/1-Methyl-4-n-propylBZ | 0.23 | 0.03 | 0.14 |
| 1,2-Diethylbenzene | 0.07 | 0.01 | 0.05 |
| 1,3-Dimethyl-2-ethylbenzene | 0.19 | 0.01 | 0.08 |
| 1-Methyl-2-n-propylbenzene | 0.35 | 0.04 | 0.19 |
| 4-Methyldecane | 0.16 | 0.02 | 0.09 |
| 1,4-Dimethyl-2-ethylbenzene | 0.24 | 0.03 | 0.12 |
| 1,3-Dimethyl-4-ethylbenzene | 0.23 | 0.02 | 0.12 |
| 3-Methyldecane | 0.15 | 0.02 | 0.10 |
| 1,2-Dimethyl-4-ethylbenzene | 0.23 | 0.02 | 0.12 |
| 1-Methyl-4-terbutylbenzene | 0.23 | 0.04 | 0.22 |
| 4-Methylindane | 0.37 | 0.00 | 0.00 |

-continued

Comparison Data of the Three Analysis

| Component Name | Untreated Feed Mole % | Calcium Oxide Mole % | Dolomitic Oxide Mole % |
|---|---|---|---|
| 1,2-Dimethyl-3-Ethylbenzene | 0.32 | 0.00 | 0.00 |
| 1,2,4,5-Tetramethylbenzene (Durene) | 0.23 | 0.01 | 0.09 |
| N-Undecane | 0.38 | 0.04 | 0.20 |
| C11 Aromatics | 3.49 | 0.03 | 0.66 |
| 1,2,3,5-Tetramethylbenzene (Isodurene) | 0.30 | 0.01 | 0.10 |
| 1,2,3,4-Tetramethylbenzene (Prehnitene) | 0.34 | 0.01 | 0.09 |
| Pentylbenzene | 0.18 | 0.00 | 0.02 |
| 5-Methylindane | 0.14 | 0.00 | 0.00 |
| Naphthalene | 0.24 | 0.01 | 0.05 |
| N-Dodecane | 0.25 | 0.00 | 0.04 |
| 2-Methylnaphthalene | 0.36 | 0.00 | 0.04 |
| 1-Methylnaphthalene | 0.35 | 0.00 | 0.01 |
| C-12 thru C-13 | 3.62 | 0.00 | 0.00 |
| N-Tridecane | 0.23 | 0.00 | 0.01 |
| C-13 thru C-14 | 3.54 | 0.00 | 0.00 |
| N-Tetradecane | 0.31 | 0.00 | 0.00 |
| C-14 plus | 2.83 | 0.00 | 0.00 |
| Unidentified | 7.35 | 1.32 | 0.53 |
| | 100.00 | 100.00 | 100.00 |

Comparison of Groups of Organic Molecules
Present in Untreated Feed, CaO/Catalyst Treated, Dolomitic Oxide/Catalyst Treated Streams

| | Feed | Paraffin CaO | Mg/CaO | Feed | Isopara. CaO | Mg/CaO | Feed | Olefins CaO | Mg/CaO | Feed | Naphth. CaO | Mg/CaO | Feed | Aromatic CaO | Mg/CaO |
|---|---|---|---|---|---|---|---|---|---|---|---|---|---|---|---|
| C4 | 1.69 | 3.51 | 2.52 | 0.56 | 0.85 | 0.66 | 0.00 | 0.00 | 0.00 | | | | | | |
| C5 | 2.29 | 7.26 | 4.44 | 2.50 | 5.55 | 3.46 | 0.00 | 0.00 | 0.00 | 0.41 | 0.98 | 0.60 | | | |
| C6 | 2.15 | 7.59 | 4.82 | 4.30 | 10.98 | 6.81 | 0.00 | 0.00 | 0.00 | 6.93 | 3.37 | 4.67 | 0.21 | 0.50 | 0.34 |
| C7 | 1.37 | 4.22 | 3.39 | 3.80 | 8.49 | 6.25 | 0.00 | 0.00 | 0.00 | 9.89 | 5.92 | 7.90 | 0.53 | 1.22 | 1.09 |
| C8 | 1.31 | 2.02 | 2.42 | 3.55 | 5.02 | 5.13 | 0.00 | 0.00 | 0.00 | 8.62 | 7.23 | 14.54 | 2.31 | 1.78 | 2.61 |
| C9 | 0.78 | 0.64 | 1.26 | 2.81 | 2.87 | 4.30 | | | | 5.30 | 7.70 | 8.83 | 2.78 | 0.97 | 2.58 |
| C10 | 0.62 | 0.20 | 0.65 | 2.56 | 0.66 | 3.03 | | | | 0.81 | 2.94 | 2.29 | 4.64 | 0.54 | 2.40 |
| C11 | 0.51 | 0.06 | 0.30 | 0.41 | 0.06 | 0.29 | | | | | | | 5.16 | 0.09 | 1.11 |
| Total LV % | 10.73 | 25.50 | 19.80 | 20.48 | 34.48 | 29.94 | 0.00 | 0.00 | 0.00 | 32.53 | 27.56 | 38.82 | 15.63 | 5.10 | 10.12 |
| Unidentified | 25.60 | 2.39 | 1.32 | | | | | | | | | | | | |

| | Feed | CaO | Dolomitic Oxide |
|---|---|---|---|
| Mol Wt of Sample | 121.3 | 93.9 | 102.1 |
| Mol Wt C6 Plus | 127.9 | 101.2 | 108.4 |
| Density of Sample | 0.7826 | 0.7118 | 0.7359 |
| Density C6 Plus | 0.7962 | 0.7318 | 0.7518 |

From the foregoing results, it can be readily appreciated that this invention is highly effective as a desulfurization process to remove sulfur and sulfur compounds from hydrocarbon streams. The desulfurization processes previously known, such as the Claus Process, the Shell Sulfinol (Sulfonyl) Process, and others, do not remove as high a proportion of sulfur from the hydrocarbon streams. Cost of operation for these earlier processes, which require massive equipment and special metallurgy, is in excess of $0.40 per barrel. To the contrary, the desulfurization process of this invention will be less than $0.06 per barrel in processing costs and will require only minimal equipment of ordinary carbon steel.

Additionally, the foregoing results show that the process of this invention improves significantly the quality and commercial value of refinery hydrocarbon streams by dehydrogenation of alicyclic compounds to aromatic compounds, by hydrocracking paraffins so that long chain molecules may be broken into more volatile, shorter chain molecules, by cyclization and isomerization of straight chain paraffins to increase octane rating, by dehydrocyclization of straight chain paraffins to naphthenes can then be converted to an aromatic product, and by removing naphthenic acid as a naphtha product.

From the foregoing it will be seen that this invention is one well adapted to attain all end and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A desulfurization process for a petroleum stream comprising the steps of:

heating a hydrocarbon feed stream containing one or more sulfur compounds selected from the group consisting of hydrogen sulfide and mercaptans to at least 200° F.;

contacting said hydrocarbon stream in intimate admixture with a lime/catalyst water solution in a mass transfer relationship, said lime/catalyst water solution comprising a lime component selected from the group consisting of lime (CaO), dolomitic lime (MgO.CaO), limestone ($CaCO_3$), dolomitic limestone ($CaCO_3.MgCO_3$), and mixtures thereof, a dibasic acid catalyst and water;

separating a vapor phase and a liquid phase from said contacting step wherein said vapor phase is virtually free of sulfur compounds and said liquid phase contains said sulfur compounds of said feed stream.

2. The process as in claim 1, said dibasic acid catalyst comprising one or more dicarboxylic acids selected from the group consisting of butanedioic acid, pentanedioic acid, hexanedioic acid, heptanedioic acid, octanedioic acid, nonanedioic acid, decanedioic acid, undecanedioic acid, and dodecanedioic acid.

3. The process as in claim 2, said dibasic acid catalyst comprising one or more dicarboxylic acids selected from the group consisting of butanedioic acid, pentanedioic acid, and hexanedioic acid.

4. The process as in claim 1, said lime component present in said solution in the range of 2 to 15% by weight, and said dibasic acid catalyst present in said solution in the range of 1 to 10% by weight.

5. The process as in claim 4, said lime component present in said solution in the range of 8 to 12% by weight, and said dibasic acid catalyst present in said solution in the range of 3 to 7% by weight.

6. The process as in claim 5, said lime component present in said solution in an amount of about 10% by weight, and said dibasic acid catalyst present in an amount of about 5% by weight.

7. The process as in claim 1 wherein said heating step comprises heating said hydrocarbon feed stream to a temperature in the range of 200° F. and 930° F.

8. The process as in claim 7 wherein said heating step comprises heating said hydrocarbon feed stream to a temperature in the range of 200° F. and 650° F.

9. The process as in claim 8 wherein said heating step comprises heating said hydrocarbon feed stream to a temperature in the range of 400° F. and 450° F.

10. A naphthenic acid conversion process comprising the steps of:

heating hydrocarbon feed stream containing one or more naphthenic acid compounds to at least 200° F.;

contacting said hydrocarbon stream in intimate admixture with a lime/catalyst water solution in a mass transfer relationship, said lime/catalyst water solution comprising a lime component selected from the group consisting of lime (CaO), dolomitic lime (MgO.CaO), limestone ($CaCO_3$), dolomitic limestone ($CaCO_3.MgCO_3$), and mixtures thereof, a dibasic acid catalyst and water;

separating a vapor phase and a liquid phase from said contacting step wherein said vapor phase has reduced amounts of said naphthenic acid compounds and enriched amounts of branched aromatic compounds.

11. The process as in claim 10, said dibasic acid catalyst comprising one or more dicarboxylic acids selected from the group consisting of butanedioic acid, pentanedioic acid, hexanedioic acid, heptanedioic acid, octanedioic acid, nonanedioic acid, decanedioic acid, undecanedioic acid, and dodecanedioic acid.

12. The process as in claim 11, said dibasic acid catalyst comprising one or more dicarboxylic acids selected from the group consisting of butanedioic acid, pentanedioic acid, and hexanedioic acid.

13. The process as in claim 10, said lime component present in said solution in the range of 2 to 15% by weight, and said dibasic acid catalyst present in said solution in the range of 1 to 10% by weight.

14. The process as in claim 13, said lime component present in said solution in the range of 8 to 12% by weight, and said dibasic acid catalyst present in said solution in the range of 3 to 7% by weight.

15. The process as in claim 14, said lime component present in said solution in an amount of about 10% by weight, and said dibasic acid catalyst present in an amount of about 5% by weight.

16. The process as in claim 10 wherein said heating step comprises heating said hydrocarbon feed stream to a temperature in the range of 200° F. and 930° F.

17. The process as in claim 16 wherein said heating step comprises heating said hydrocarbon feed stream to a temperature in the range of 200° F. and 650° F.

18. The process as in claim 17 wherein said heating step comprises heating said hydrocarbon feed stream to a temperature in the range of 400° F. and 450° F.

19. A process for enhancing the hydrocarbon quality and commercial value of a petroleum stream comprising the steps of:

heating a hydrocarbon feed stream containing high molecular weight, high boiling point fractions to at least 200° F.;

contacting said hydrocarbon stream in intimate admixture with a lime/catalyst water solution in a mass transfer relationship, said lime/catalyst water solution comprising a lime component selected from the group consisting of lime (CaO), dolomitic lime (MgO.CaO), limestone ($CaCO_3$), dolomitic limestone ($CaCO_3.MgCO_3$), and mixtures thereof, a dibasic acid catalyst and water;

recovering a hydrocarbon stream from said contacting step wherein said recovered hydrocarbon stream contains lower molecular weight, lower boiling point and more highly branched hydrocarbon compounds than those contained in said feed stream.

20. The process as in claim 19, said dibasic acid catalyst comprising one or more dicarboxylic acids selected from the group consisting of butanedioic acid, pentanedioic acid, hexanedioic acid, heptanedioic acid, octanedioic acid, nonanedioic acid, decanedioic acid, undecanedioic acid, and dodecanedioic acid.

21. The process as in claim 20, said dibasic acid catalyst comprising one or more dicarboxylic acids selected from the group consisting of butanedioic acid, pentanedioic acid, and hexanedioic acid.

22. The process as in claim 19, said lime component present in said solution in the range of 2 to 15% by weight, and said dibasic acid catalyst present in said solution in the range of 1 to 10% by weight.

23. The process as in claim 22, said lime component present in said solution in the range of 8 to 12% by weight, and said dibasic acid catalyst present in said solution in the range of 3 to 7% by weight.

24. The process as in claim 23, said lime component present in said solution in an amount of about 10% by weight, and said dibasic acid catalyst present in an amount of about 5% by weight.

25. The process as in claim 19 wherein said heating step comprises heating said hydrocarbon feed stream to a temperature in the range of 200° F. and 930° F.

26. The process as in claim 25 wherein said heating step comprises heating said hydrocarbon feed stream to a temperature in the range of 200° F. and 650° F.

27. The process as in claim 26 wherein said heating step comprises heating said hydrocarbon feed stream to a temperature in the range of 400° F. and 450° F.

28. A desulfurization process for natural gas comprising the steps of:

contacting a natural gas feed stream containing hydrogen sulfide compounds in intimate admixture with a lime/catalyst water solution in a mass transfer relationship, said lime/catalyst water solution comprising a lime component selected from the group consisting of lime (CaO), dolomitic lime (MgO.CaO), limestone ($CaCO_3$), dolomitic limestone ($CaCO_3.MgCO_3$), and mixtures thereof, a dibasic acid catalyst and water;

separating a vapor phase and a liquid phase from said contacting step wherein said vapor phase is virtually free of sulfur compounds and said liquid phase contains said sulfur compounds of said feed stream.

29. The process as in claim 28, said dibasic acid catalyst comprising one or more dicarboxylic acids selected from the group consisting of butanedioic acid, pentanedioic acid, hexanedioic acid, heptanedioic acid, octanedioic acid, nonanedioic acid, decanedioic acid, undecanedioic acid, and dodecanedioic acid.

30. The process as in claim 28, said dibasic acid catalyst comprising one or more dicarboxylic acids selected from the group consisting of butanedioic acid, pentanedioic acid, and hexanedioic acid.

31. The process as in claim 28, said lime component present in said solution in the range of 2 to 15% by weight, and said dibasic acid catalyst present in said solution in the range of 1 to 10% by weight.

32. The process as in claim 31, said lime component present in said solution in the range of 8 to 12% by weight, and said dibasic acid catalyst present in said solution in the range of 3 to 7% by weight.

33. The process as in claim 32, said lime component present in said solution in an amount of about 10% by weight, and said dibasic acid catalyst present in an amount of about 5% by weight.

* * * * *